US006471444B1

(12) United States Patent
Pollack

(10) Patent No.: US 6,471,444 B1
(45) Date of Patent: Oct. 29, 2002

(54) SPAR CONSTRUCTION METHOD

(75) Inventor: Jack Pollack, Monaco (MC)

(73) Assignee: Offshore Energy Development Corporation (OEDC), Monaco Cedex (MC)

( * ) Notice: Subject to any disclaimer, the term of this patent is extended or adjusted under 35 U.S.C. 154(b) by 0 days.

(21) Appl. No.: 09/646,865

(22) PCT Filed: Mar. 25, 1999

(86) PCT No.: PCT/EP99/02101

§ 371 (c)(1),
(2), (4) Date: Sep. 25, 2000

(87) PCT Pub. No.: WO99/48753

PCT Pub. Date: Sep. 30, 1999

(30) Foreign Application Priority Data

Mar. 25, 1998 (EP) ..... 98200942

(51) Int. Cl.[7] ..... E02B 17/08
(52) U.S. Cl. ..... 405/203; 405/205; 405/206
(58) Field of Search ..... 405/195.1, 205, 405/202, 204, 206, 203, 207; 114/264, 256

(56) References Cited

U.S. PATENT DOCUMENTS

| | | | | |
|---|---|---|---|---|
| 3,673,973 A | | 7/1972 | Glosten | |
| 3,714,788 A | * | 2/1973 | Mott | 61/46.5 |
| 3,977,346 A | * | 8/1976 | Natvig et al. | 114/65 R |
| 4,127,004 A | * | 11/1978 | Vilain | 405/202 |
| 4,249,618 A | * | 2/1981 | Lamy | 175/9 |
| 4,819,730 A | * | 4/1989 | Williford et al. | 166/355 |
| 4,927,296 A | * | 5/1990 | Kaldenbach | 405/206 |
| 5,439,321 A | * | 8/1995 | Hunter | 405/195.1 |
| 5,542,783 A | | 8/1996 | Pollack | |
| 6,276,876 B1 | * | 8/2001 | Bone et al. | 405/205 |

FOREIGN PATENT DOCUMENTS

| | | |
|---|---|---|
| FR | 1 437 689 | 7/1966 |
| FR | 2 081 319 | 5/1970 |
| WO | WO 97/29948 | 8/1997 |

* cited by examiner

*Primary Examiner*—Thomas B. Will
*Assistant Examiner*—Raymond W Addie
(74) *Attorney, Agent, or Firm*—Young & Thompson

(57) ABSTRACT

A method of constructing SPAR buoys comprising an elongate floating body (1) and a deck structure (2). The elongate body (1) is transported to the mooring site in its horizontal position. During erecting of the floating body (1) by ballasting it with water and alignment with the deck structure (2), the deck structure (2) remains attached to its buoyancy member (7). Hereby the use of large derricks can be avoided which provides a substantial cost reduction. After erecting the floating body, the body (1) may be ballasted to pass below the floating deck structure (2). Alternatively, the deck structure (2) may be deballasted or pulling cables (14) may be used to pull the coupling member (4) of the floating body (1) into contact with the coupling member (12) of the deck construction. Alternatively, the floating body (1) is at its upper ends connected to the deck structure (2) via a pivoting connection (22) such that during coupling the floating body may be hinged against the deck structure (2).

12 Claims, 2 Drawing Sheets

SPAR CONSTRUCTION METHOD

The invention relates to a method of constructing a floating structure comprising an elongate floating body and a deck structure connected to the upper end of the floating body, the method comprising the steps of:

providing the elongate body, providing the deck structure, wherein the deck structure and the elongate body are each provided with coupling means for connecting the elongate body and the deck structure, transporting the elongate body to its mooring site, transporting the deck structure on a buoyancy member to the mooring site, ballasting the elongate body such that it is in its vertically upright position and connecting the deck structure to the upper part of the elongate body via the respective coupling means.

In the offshore oil industry, SPAR buoys are known for oil production and storage in deep water. The SPAR buoy comprises an elongate cylindrical lower part which may have a diameter of over 20 meters and a height or more than 100 meters. The deep draft cylindrical body is provided at its upper part with a super structure that may comprise oil or gas production equipment or a drilling rig. The cylindrical body is in its vertical position anchored to the sea bed by means of vertical tethers, and/or catenary or taut radial mooring lines. The subsea well head is connected to the floating body by a number of risers which transfer oil and/or gas to the upper deck structure. The main cylinder of the SPAR buoy may comprise storage and ballast tanks and may have a central well through which the risers extend to the production trees on the upper deck structures It known to horizontally construct the main floating cylindrical body of the SPAR buoy, subsequently ballast it and tow it to its mooring site in a horizontal position. Thereafter the superstructure is placed on a barge and is also towed to the mooring site. By ballasting the floating body it is placed into its vertically upright position whereafter the superstructure is lifted as a whole or in parts from the barge by means of a derrick. This construction method is relatively costly and can only be carried out with large derricks, which may have to lift superstructures weighing 5000 tons or more.

Therefore it is an object of the present invention to provide a SPAR construction method which is relatively cheap and which can be carried out in a simple and reliable manner. Thereto the invention is characterized in that the relative position of the deck structure and the buoyancy member is maintained generally constant during alignment and connecting of the deck structure and the elongate body.

The invention is based on the insight that the buoyancy member of the deck structure should remain active during coupling of the SPAR body and the deck structure. When the SPAR body is erected by being ballasted with sea water, it can be brought to the required height so that it can pass underneath the floating super structure. Alternatively, the super structure may be deballasted in such a way that is high enough above water level to be able to pass over and be aligned with the upright floating SPAR body. After alignment of the deck structure and the vertical SPAR body, they are interconnected via the coupling means, wherein the deck structure may be lowered onto the SPAR body for instance by ballasting or winching via connecting cables, or wherein the SPAR body may be raised by deballasting, optionally in combination with winching along connecting cables. By making effective use of the buoyancy of the deck structure, large lifting derricks need not be applied during connection of the upright SPAR body and the deck structure, which gives rise to considerable cost savings.

The buoyancy member of the deck structure may comprise a barge-like construction that is provided with the coupling means near keel level. In an alternative embodiment, the buoyancy member comprises two spaced apart floating elements between which the connecting element of the upright SPAR body can be placed. After connection of the SPAR body and the deck structure, the buoyancy member may be raised above water level and can be used as a structural part of the deck structure for instance serving as personnel quarters. Alternatively the buoyancy member may be decoupled after completion of the SPAR buoy according to the present invention.

According to a specific embodiment of the method according to the present invention, the elongate body is in a horizontal position connected to the floating deck structure via a pivot construction. At the mooring site, the elongate body is placed in its upright position while pivoting it with respect to the deck structure around the pivot construction such that the coupling means of the deck structure are brought into contact with the coupling means of the elongate body. By the pivot connection, an accurate alignment between the deck structure and the horizontal SPAR buoy can take place. The pivot connection may be established at the mooring site, but can also be installed before combined transport of the deck structure and the elongated horizontal SPAR body, mutually connected by the pivot construction. During transport, additional reinforcing brackets may be mounted between the deck structure and the horizontal SPAR buoy for taking up the forces on the pivot construction and for providing a temporary increased stiffness between the deck structure and the horizontal SPAR body. At the mooring site the reinforcing brackets may be removed before erecting the SPAR body.

The SPAR body and/or the deck structure may be provided with horizontal thrusters that can propel the deck structure and the SPAR body during transport and which may after erecting of the SPAR buoy and connecting it to the deck structure, function to maintain the proper vertical position of the SPAR buoy.

Some embodiments of the SPAR construction method according to the present invention will by way of example be illustrated with reference to the accompanying drawings.

Figure 1:
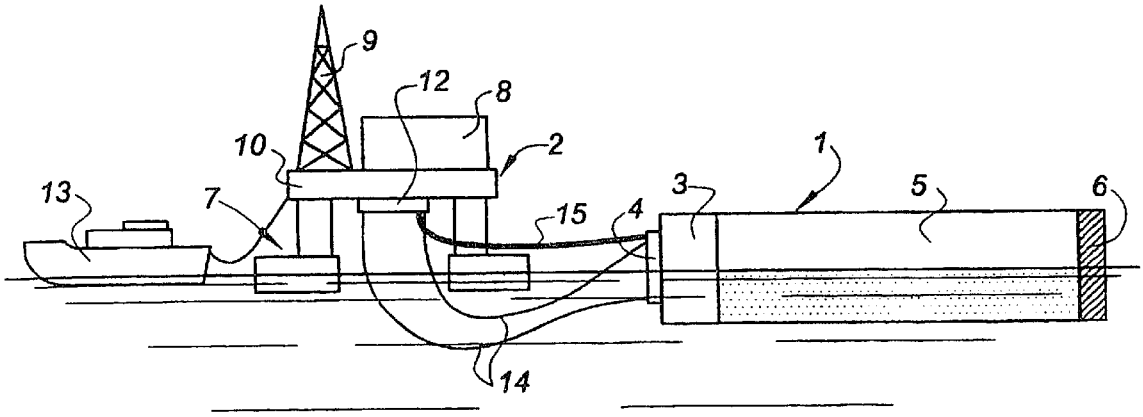
FIG. 1 shows a schematic side view of the transport of the top deck module and an elongated SPAR body to a mooring site.

FIG. 1 shows the elongate floating SPAR body 1 and a top deck module 2 for forming a SPAR buoy. The floating body 1 is partly ballasted with water for an increased stability and comprises at its top end 3 a coupling member 4 and at its bottom end 5 ballast material 6. The deck structure 2 comprises a buoyancy member 7 on which production equipment 8, and alternatively a drilling rig 9 are supported. At the bottom of the supporting deck 10, a complementary coupling member 12 is provided for attaching to the coupling member 4 of the floating body 1. The deck module 2 and the horizontal floating body 1 are towed to their mooring site by a tug 13, wherein for the embodiment shown in FIG. 1, the deck structure 2 and the floating body 1 are mutually connected by towing/guiding cables 14 and by control or air lines 15. The control or air lines 15 may be used for ballasting or deballasting the elongate floating body 1 or may comprise hydraulic lines for actuating the coupling member 4. Although it has been shown in FIG. 1 that the deck module 2 and the SPAR body 1 are towed together, it is also possible to tow them separately to the mooring site.

Figure 2:
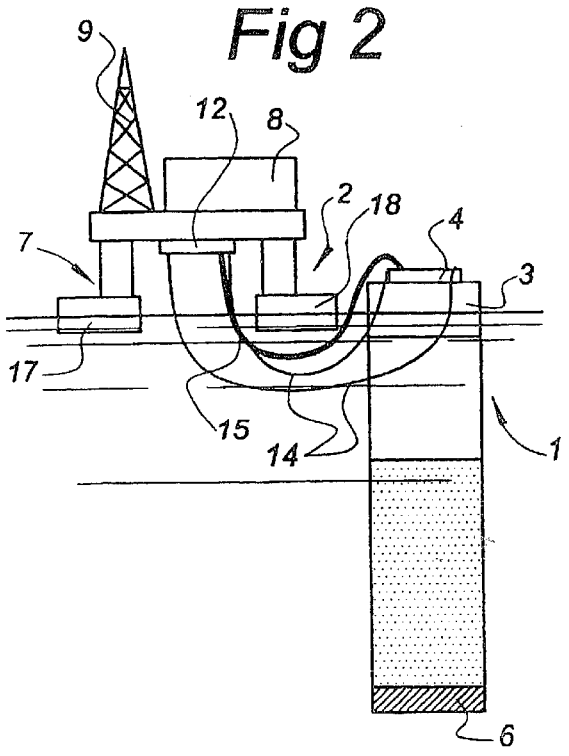
FIG. 2 shows the SPAR body being placed in its vertical position.

As can be seen from FIG. 2, the floating body 1 is erected by ballasting it with water until it is in its upright position. In the embodiment shown in FIG. 2, the buoyancy member 7 comprises two spaced apart floating elements 17, 18 forming a U-shaped catamaran like floating profile. The distance between the elements 17 and 18 is large enough for the coupling member 4 of the floating body 1 to pass therebetween when the floating body 1 is manoeuvred into alignment with the coupling member 12. For aligning the floating body 1 with the deck module 2, the towing/guiding cables 14 may be tightened. It is also possible to further ballast the floating body 1 such that its coupling member 4 is allowed to pass below the buoyancy member 7, such that the elements 17 and 18 can in that case be closer together. Again alternatively, the buoyancy member 7 can form one closed hull wherein the coupling member 12 can be placed at keel level thereof, below the water line.

Figure 3:
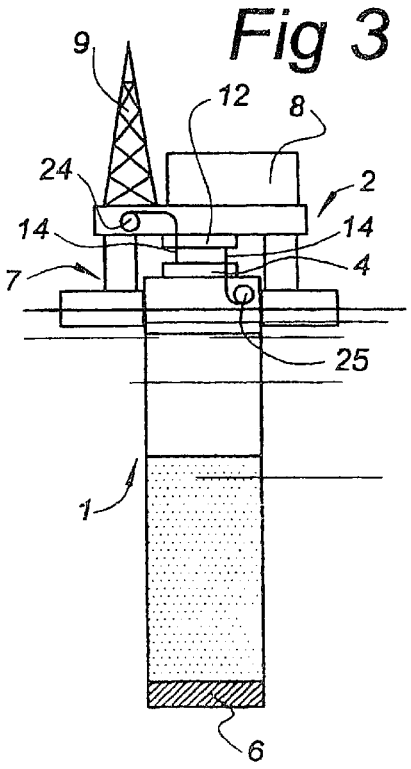
FIG. 3 shows a schematic view of the alignment of the top deck module and the SPAR body.
Figure 4:
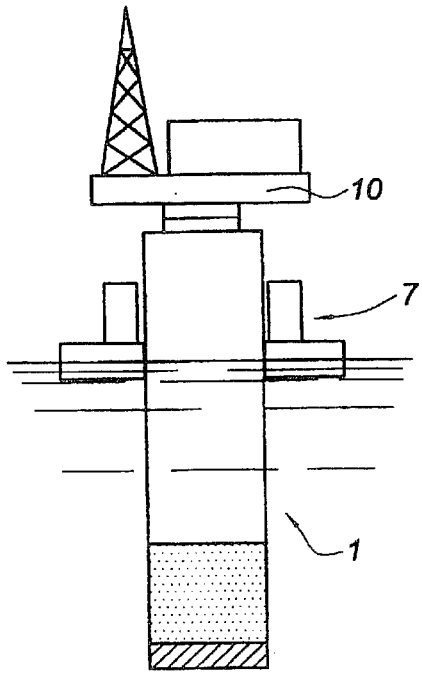
FIG. 4 shows the completed SPAR buoy wherein the buoyancy member is disconnected.

FIG. 3 shows the situation in which the floating body 1 and the deck module 2 are placed in alignment such that the coupling members 4 and 12 can be connected. In order to place the coupling members 4, 12 in a contacting relationship, the floating body 1 may be deballasted, the buoyancy member 7 may be ballasted or the deck module 2 and the floating body 1 may be pulled together by shortening interconnecting cables 14 or any combination thereof. The cables 14 may be connected to winches 24, 25 on the deck module 2, on the floating body 1 or on both. After connecting the coupling members 4 and 12, the floating body 1 may be further deballasted such that the deck module 2 is raised further above water level. Before further deballasting the floating body 1, the buoyancy member 7 may be decoupled from the supporting platform 10 as is shown in FIG. 4, so that it can be removed and used for installing another SPAR buoy according to the method that has been described above. Alternatively, the buoyancy member 7 can remain attached to the supporting platform 10 for instance for use as housing quarters or storage space.

Although it has been shown in FIGS. 1 to 4 that the floating body 1 is partly ballasted, it may also be ballasted such as to have a negative buoyancy and be totally submerged below water level, while being supported by the buoyant deck module 2. In this way the floating body 1 is relatively insensitive to wave and wind influences and can be raised by winches until the coupling members are connected.

Figure 5:
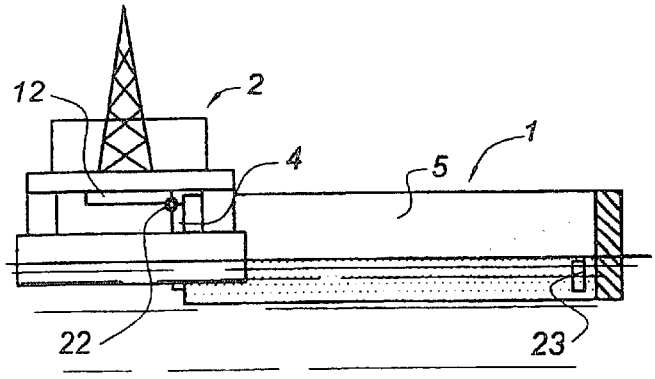
FIG. 5 shows an alternative embodiment wherein the top deck module and the SPAR body are connected via a pivot construction.
Figure 6:
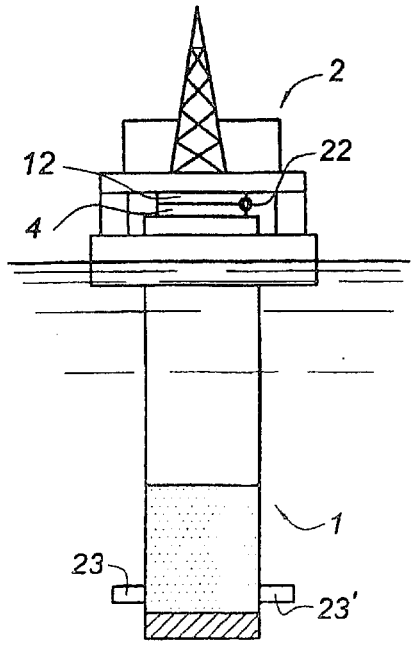
FIG. 6 shows the alignment and attachment of the top deck module and the SPAR body by pivoting the SPAR body with respect to the deck module.

FIG. 5 shows another embodiment of a SPAR construction method according to the present invention wherein the floating body 1 is connected to the deck module 2 via a pivoting construction 22, which may comprise a ball or a gimball joint. The pivoting connection may be established before or after transport to the mooring site. When the floating body 1 is erected, the pivoting construction 22 provides for accurate alignment of the coupling members 4 and 12 of the deck module 2 and the floating body 1. As shown in FIG. 5, the floating body 1 is during transport partially ballasted for increased stability. At the lower end 5 the floating body 1 is provided with azimuth thrusters 23, 23', at least one on each side of the longitudinal centre line of the floating body 1. During transport, the azimuth thrusters 23, 23' may be used for propulsion whereas in the erected position of the SPAR buoy they may used for positioning purposes.

After connecting the coupling members 4, 12 they may be secured with hydraulic or pneumatic locking mechanisms as are well known in the offshore technology. Alternatively, the coupling members may be connected by bolts or welding or any equivalent means.

What is claimed is:

1. Method of constructing a floating structure comprising an elongate floating body (1) and a deck structure (2) connected to the upper end (3) of the floating body (1) comprising the steps of:

providing the elongate body, providing the deck structure, wherein the deck structure and the elongate body are each provided with coupling means (4, 12) for connecting the elongate body and the deck structure, transporting the elongate body to its mooring site, transporting the deck structure on a buoyancy member to the mooring site, ballasting the elongate body such that it is in its vertically upright position, positioning the elongate body below the deck structure, and raising the elongate body by deballasting it, wherein the elongate body comprises an elongate buoy for oil production and storage and comprising storage and ballast tanks, and having at its bottom ballast material (6) which is retained upon placing the buoy in its upright position, the deck structure and the elongate body during transport being coupled via control lines (15), the control lines (15) being connected between the deck structure (2) and the floating body (1) for control of the ballasting of the elongate body by supply or removal of water to the ballast tanks during transportation of the elongate body, erection and operation, the control lines (15) remaining attached between the deck and body after erecting of the elongate body, the elongate body being free from external buoyancy members prior to erecting said body.

2. Method according to claim 1, wherein the deck structure (2) is mounted on buoyancy members (7) which are at a mutually spaced apart distance that is larger than the diameter of the coupling means (4) of the elongate body.

3. Method according to claim 1, further comprising:

placing the coupling means (4) of the elongate body at a vertical position that is lower than the vertical position of the coupling means (12) of the deck structure (2), aligning the coupling means (4, 12) of the floating deck structure (2) and the elongate body (1), and connecting the aligned deck structure and the elongate body.

4. Method of constructing a floating structure according to claim 1, further comprising:

connecting the elongate body in a horizontal position to the floating deck structure via a pivot construction (22), placing the elongate body in its upright position while pivoting it with respect to the deck structure around the pivot construction such that the coupling means of the deck structure are brought into contact with the coupling means of the elongate body.

5. Method according to claim 4, wherein the deck structure and the elongate body are transported to the mooring site while connected via the pivot construction.

6. Method according to claim 1, wherein after alignment of the deck structure and the elongate body, the deck structure is ballasted such as to be lowered onto the elongate body.

7. Method according to claim 1, wherein the deck structure and the elongate body are connected by at least one cable (14), wherein during connecting of the elongate body and the deck structure, the cable is shortened by a cable pulling device (24, 25) mounted on the deck structure and/or on the floating body.

8. Method according to claim 1, wherein after connecting the elongate body and the deck structure, the buoyancy member is disconnected from the deck structure whereafter the buoyancy of the buoy is increased and/or the buoyancy member is ballasted to provide clearance between the deck structure and the buoyancy member such that the buoyancy member can be removed.

9. Method according to claim 1, wherein the buoyancy member comprises two or more spaced apart partially submerged floating elements.

10. Method according to claim 1, wherein the elongate body comprises at least two thrusters (23, 23').

11. Method according to claim 1, wherein the floating member of the deck structure comprises at least two thrusters.

12. Method according to claim 1, wherein the elongate body (1) is ballasted such as to have a negative buoyancy, while being supported by the upper deck structure (2).

* * * * *